United States Patent [19]

Blum

[11] Patent Number: 5,008,940

[45] Date of Patent: Apr. 16, 1991

[54] METHOD AND APPARATUS FOR ANALYZING AND RECONSTRUCTING AN ANALOG SIGNAL

[75] Inventor: Dieter W. Blum, Vancouver, Canada

[73] Assignee: Integrated Circuit Technologies Ltd., Bridgetown, Barbados

[21] Appl. No.: 311,241

[22] Filed: Feb. 15, 1989

[30] Foreign Application Priority Data

Feb. 16, 1988 [CA] Canada ..... 558977

[51] Int. Cl.[5] ..... G10L 5/00

[52] U.S. Cl. ..... 381/31; 375/37; 381/36

[58] Field of Search ..... 381/31, 36; 375/37

[56] References Cited

U.S. PATENT DOCUMENTS 4,382,160 5/1983 Gosling ..... 381/31
4,613,974 9/1986 Vokac ..... 375/37

OTHER PUBLICATIONS

F. A. Marvasti, "A Unified approach to Zero Crossings and Non uniform Sampling", 1987, II. 6, pp. 8–19,22,23,28–33.

R. A. King and W. Gosling, "Time Encoded Speech," unpdated, pp. 140–143.

S. Kay "Zero Crossing Based Spectrum Analyzer", IEEE Transactions, ASSP-34, Feb. 1986, pp. 96–104.

A. Zakhor & A. Oppenheim, "Reconstruction of Two-dimensional Signals from Level Crossings," IEEE Proceedings, Jan. 1990, vol. 78, No. 1, pp. 31–55.

*Primary Examiner*—Emanuel S. Kemeny
*Attorney, Agent, or Firm*—Robert H. Wilkes

[57] ABSTRACT

The methods and apparatus disclose a signal processing system acquiring the half-period and magnitude of the highest frequency component at any one time of an analog signal. Two comparators compare positive and negative going slopes of the signal to respective out of phase versions of themselves. Maxima and minima are detected by the respective comparators to set and reset two timers. The timers time the lengths of the positive and negative going slopes between the maxima and minima. An analog to digital converter converts the magnitude of the signal at the maxima and minima. A microprocessor stores the times and magnitudes in a memory and is in a second embodiment adapted to determine the individual frequency components of the signal from the stored values. The acquired values may be transmitted in digital form or may be reconstructed for analog transmission. The signal may be reconstructed by a microprocessor downloading the positive and negative slope times to a pair of comparators and resetting the respective counters. The magnitude values are converted by digital to analog converter and output through a low-pass filter until the respective comparator values match the counter values. In a third embodiment a number of processing systems are linked to selectively determine the frequency components of the signal.

34 Claims, 2 Drawing Sheets

METHOD AND APPARATUS FOR ANALYZING AND RECONSTRUCTING AN ANALOG SIGNAL

FIELD OF THE INVENTION

The invention relates to methods and apparatus for the acquisition and reconstruction of continuous analog signals.

BACKGROUND OF THE INVENTION

Systems in this field are well known in the art. Original systems employ time domain techniques. The amplitude of a given signal is acquired at a fixed sampling rate. The sampling rate is generally many times higher than the highest frequency of the signal. The accumulated number of bits from such a sampling rate requires a large storage capacity and/or a fast transmission rate.

In order to decrease the required capacity various techniques have been devised for compressing the amount of information required to be transmitted in these time domain systems. Time domain compression techniques can result in systems which are complex and which tend to degrade the quality of the reconstructed signal.. Such systems are disclosed in U.S. Pat. No. 4,382,160 issued May 3, 1983 to Gosling et al; 4,630,257 issued Dec. 16, 1986 to White; 4,404,532 issued Sep. 13, 1983 to Welti; 3,973,081 issued Aug. 3, 1976 to Hutchins; and 3,621,150 issued Nov. 16, 1971 to Lyndeborough.

The system disclosed in the Gosling et al patent discloses methods and apparatus for encoding and constructing speech signals. The disclosure describes a system having an analog to digital converter sampling at rates of approximately 20,000 samples per second. This is two to ten times the Nyquist criteria but is necessary to ensure no useful information, is lost between samples.

The A to D converter is connected to two storage means which store the present sample and the preceding sample. A comparator compares the two samples to determine when there is a maxima or minima in the signal. The A to D converter also detects zero crossings on a datum line and signals such crossings by changes in its plurality bit.

A first counter counts the number of maxima and minima between consecutive zero crossings. A second counter counts the period of time elapsed between the consecutive zero crossings.

The time and number of maxima and minima for a period are compared to values in a look-up table and translated into a number representing a matching value. This number is transmitted and reconstruction is based on the transmitted number.

This system does not reconstruct the signal to have the maxima and minima in the positions in which they occurred in the original signal, but only reconstructs the signal to have the given number of maxima and minima between zero crossings. As well this system does not retain the amplitude information. Additionally, the signal is required to fit within certain parameters or else the size of the look-up table will become unmanageable. The reconstructed signal loses specific keys to intelligibility when dealing with speech signals and, more importantly, by the inventors own admission cannot be applied to signals outside of the speech field.

In order to further reduce the amount of information required to be stored or transmitted techniques in the frequency domain have been developed. Related patents include U.S. Pat. No. 4,622,680 issued Nov. 11, 1986 to Zinser; 4,086,174 issued Apr. 29, 1986 to Wong; 4,374,304 issued Feb. 15, 1983 to Flannigan; 4,086,431 issued Apr. 25, 1978 to Franssen; 4,034,160 issued July 5, 1977 to Van Gerwen; 3,667,074 issued May 30, 1972 to Iwasaki et al; and 3,499,996 issued Mar. 10, 1970 to Klayman et al. These techniques, while decreasing the amount of transmitted information, are susceptible to errors induced by background noise. Additionally their restricted bandwidth causes the loss of many of the keys to speech. Many of the systems would not be capable of handling the bandwidth requirements of systems outside the speech field.

To decrease both the susceptibility to noise and the amount of information required to be stored digital spectral domain systems have been developed. These systems include those which employ an analog to digital converter and determine the frequency of the signal by correlation to reference samples as disclosed in PCT publication No. W087/01542. This system runs into problems similar to those of the Gosling et al patent in that look-up tables or the like are employed.

Further systems employing digital spectral techniques include those employing fourier transforms or approximations thereof. Related patents. include U.S. Pat. No. 4,667,340 issued May 19, 1987 to Armand et al; 4,536,886 issued Aug. 20, 1985 to Papamichalis et al; and 3,681,530 issued Aug. 1, 1972 to Manley et al. These fourier transform systems typically sample the signal to be acquired with an A to D converter.

Fourier transforms require magnitude samples to be acc for the inverse of the required frequency resolution. The accumulated samples may be called a record. As is evident the length of a record will increase with increasing resolution requiring increasing storage capacity. Additionally the time delay in accumulating the record increases with increasing frequency resolution.

To determine the frequency components in a signal calculations are performed on the records according to a given fourier transform algorithm. The calculations are extremely computation intensive further adding to the time delay. The longer the record length the greater length of time the calculations will take.

SUMMARY OF THE INVENTION

In a first aspect the invention provides a method of analyzing an original analog signal by detecting each maximum and minimum point of the signal, recording the time between each adjacent pair of maximum and minimum points, and sampling and recording the magnitude of the signal at each maximum and minimum point.

In a second aspect the invention provides a method of reconstructing an analog signal from a data record of maximum and minimum values of the signal and times between adjacent maximum and minimum points, the method comprising sequentially supplying the maximum and minimum values to a sample and hold unit, for holding said values prior to connection through to a lowpass filter; timing the times between the maximum and minimum points, and at the end of each time, connecting the value held in the sample and hold unit through to the lowpass filter and then supplying the next maximum or minimum value to the sample and hold unit.

In a third aspect the invention provides an apparatus for analyzing an original analog signal, the apparatus comprising: a maximum and minimum point detector having an input for the signal and a control output, the control output alternating between first and second states according to detected maximum and minimum points in the signal; timer means having a control input connected to the control output of the detector, the timer means timing the slope times between changes in state of the control out and the timer means having a timer output for the values of slope times; and a magnitude sampler having a sampler input for the original signal and a control input for he control output of the detector, the magnitude sampler sampling the magnitude of the signal when the control output changes state, and the sampler having a magnitude output for the magnitude values of the signal.

In a fourth aspect the invention provides an apparatus for reconstructing an analog signal from a data record of maximum and minimum values of the signal and times between adjacent maximum and minimum points, the apparatus comprising a sample and hold unit for holding, in sequence, the maximum and minimum values, a lowpass filter having an input for the maximum and minimum values and an analog output, a switch means connected between the sample and hold unit and the input of the lowpass filter, and control and storage means for controlling the sample and hold unit and the switch means, the switch means being actuated to sequentially connect the maximum and minimum values through the lowpass filter in accordance with the recorded times.

In a fifth aspect the invention provides a method of manipulating an original analog signal, the method comprising: detecting each maximum and minimum point of the signal; recording the time between each adjacent pair of maximum and minimum points; sampling and recording the magnitude of the original signal at each maximum and minimum point; manipulating the recorded times to produce manipulated times; manipulating the recorded magnitude values to produce manipulated values; sequentially supplying the manipulated values to a sample and hold unit; holding the manipulated values in the sample and hold unit for the duration of the corresponding manipulated time; and outputting the magnitude values through a lower pass filter at the end of each manipulated time.

In a sixth aspect the invention provides an apparatus for manipulating an original analog signal, the apparatus comprising: a maximum and minimum point detector having an input for the signal and a control output, the control output alternating between first and second states according to detected maximum and minimum points in the signal; timer means having a control input connected to the control output of the detector, the timer means timing the slope times between changes in state of the control output and the timer means having a timer output for the values of the slope times; a manipulation unit having a slope time input connected to the timer output of the timer means, the manipulation unit for manipulating the slope times to produce manipulated times; an output means having a time input for, the manipulated times from the manipulation unit, the output means outputting an output magnitude value at the manipulated times.

BRIEF DESCRIPTION OF THE DRAWINGS

For a better understanding of the present invention, and to show more clearly how it may be carried into effect, reference will now be made, by way of example to the accompanying drawings, which show in FIG. 1 a block diagram of a signal processing system according to a preferred embodiment of the present invention and in FIG. 2 a block diagram of a time-variant filter employed in the system of FIG. 1.

DETAILED DESCRIPTION OF THE PREFERRED EMBODIMENT

Figure 1:
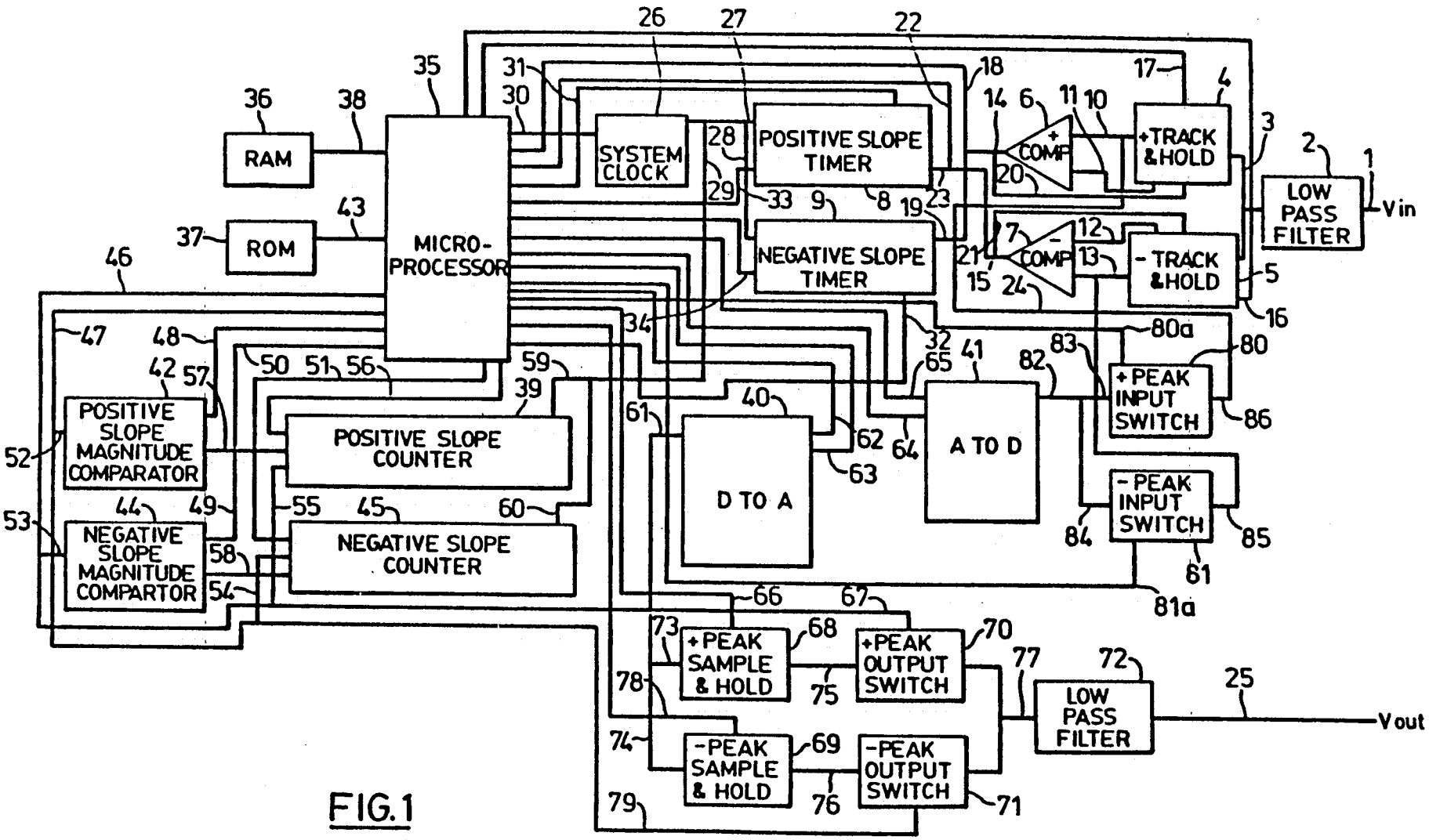

Referring to FIG. 1, there is illustrated in block diagram form a signal processing system 1. In the embodiment shown in FIG. 1 an analog input signal Vin, for example a voice frequency signal, is applied to the input of a lowpass filter 2.

While the signal processing system is depicted and will be generally described herein for utilization with analog audio signals of a restricted bandwidth, the principles of the present invention disclosed herein are equally applicable to analog signals situated elsewhere in the frequency spectrum and occupying a greater or lesser bandwidth of interest.

FILTER

The lowpass filter 2 ensures that the signal processing system of the present invention does not receive input signal frequencies above a desired upper limit. Although the sampling method utilized by the present invention varies considerably from the normal methods of analog to digital conversion and as a result does not suffer from normal aliasing effects, it is still desirable to bandlimit the input signal Vin as will be mentioned later.

MAXIMA AND MINIMA DETECTION

The output 3 of the lowpass filter 2, is fed to the inputs of a positive track and hold 4, and a negative track and hold 5. The track and holds 4 and 5, have respective outputs 10 and 13. The outputs 10, 13 are in phase with and track the input signal Vin. The track and holds 4, 5, also have respective outputs 11 and 12 that are slightly out of phase with, and normally track, the input signal Vin.

The two outputs 10 and 11 of the positive track and hold 4 are fed to the inputs of a differential comparator 6. The two outputs 12 and 13 of the negative track and hold 5 are fed to the inputs of a differential comparator 7. For the purposes of description, the two differential comparators 6, 7, are referred to as the positive slope comparator 6 and negative slope comparator 7.

Each of the comparators 6, 7, has a digital output 14, ;5. The output 14 of the positive slope comparator 6 is fed to an interrupt input on a microprocessor 35 via line 18, and to a hold trigger input on the positive track and hold 4 via line 20. The output 15 of the negative slope comparator 7 is also fed to another interrupt input on the microprocessor 35 via line 22, and to a hold trigger input on the negative track and hold 5 via line 21. Further, the positive track and hold 4, has a track trigger input which is controlled by an output from microprocessor 35 via line 17, and the negative track and hold 5 has a track trigger input which is controlled by an output from the microprocessor 35 via line 16.

The microprocessor 35 may be a suitable device providing sufficient capabilities, including speed, number of input and output lines and number of interrupt lines.

In operation, the above described configuration of track and holds 4, 5, and comparators 6, 7, operates to detect the relative maxima and minima in Vin as follows. While the input signal Vin is exhibiting a positive slope, the output 10 of the positive track and hold 4 is tracking and in phase with the input signal Vin. The output 11 of the track and hold 4 is also tracking the input signal Vin, but is slightly out of phase (lagging) behind the output 10. This causes the output 14 of positive slope comparator 6 to be in a logic low condition until a positive peak (maxima) of the input signal Vin occurs, and at this point the lagging of the output 11 behind output 10 causes the output 14 of the positive slope comparator to change state to a logic high, and remain in a logic high condition during the negative slope of the input signal Vin.

The rising edge of the logic signal at output 14 of the positive slop comparator 6 therefore corresponds with the positive peak or maxima of the input signal Vin. The track and hold 4 is set to its tracking mode by a logic signal from the microprocessor 35 via line 17.

The function of the negative slope comparator 7, the negative track and hold 5 and the associated signal and control lines is identical to that described above for the positive slope comparator 6 and positive track and hold 4, except that the rising edge of the logic signal at output 15 of the negative slope comparator 7 corresponds with the negative peak or minima of the input signal Vin.

As mentioned above the output 14 of the positive slope comparator 6, also controls the hold trigger input of the positive track and hold 4 via line 20. As a result it will be seen that the positive track and hold 4 is placed into the hold mode upon the occurrence of a rising edge of the output 14 of the positive slope comparator 6, and that the negative track and hold 5 can also be placed into the hold mode upon the occurrence of a rising edge on the output 15 of the negative slope comparator 7 since output 15 is fed to the hold trigger input of negative track and hold 5 via line 21.

SLOPE TIMING

The output 14 of the positive slope comparator 6 is fed to a timer run trigger input of a negative slope timer 9 via line 19. The output 15 of the negative slope comparator 7 is fed to a timer run trigger input of positive slope timer 8 via line 23. Both the positive slope timer 8 and the negative slope timer 9 receive a clock signal from a master system clock 26 on lines 27 and 28 respectively. It can be seen therefore, that running of the positive slope timer 8 is controlled by the rising edge of the logic signal on output 15 of the negative slope comparator 7, and that running of the negative slope timer 9 is controlled by the rising edge of the logic signal at output 14 on positive slope comparator 6.

The positive slope timer 8 and the negative slope timer 9 thereby provide precise timing of positive and negative slopes respectively to an accuracy equivalent to the time interval provided by the system clock 26, which is the inverse of the frequency of the clock 26. The slope timers 8, 9, count data may be read by the microprocessor 35 via lines 33 and 34, respectively. The slope timers 8, 9, counts may be reset to zero by the microprocessor 35 via lines 31 and 32.

As a result of this hardware configuration, the microprocessor 35 is provided with an interrupt via line 18 or 22 whenever a positive peak (maxima) occurs in the input signal Vin, and whenever a negative peak (minima) occurs in the input signal Vin. Along with the occurrences of these maxima and minima interrupts, the microprocessor 35 is capable of reading a count value out of the positive slope timer 8 and the negative slope timer 9 via lines 33 and 34 which ca provide for the precise timing of both positive and negative slope durations of the input signal Vin to a resolution determined predominantly by the frequency of the master clock system 26 and the response time of the comparators 6, 7.

ANALOG TO DIGITAL CONVERSION

When the microprocessor 35 receives a maxima interrupt from the positive slope comparator 6 on line 18 it performs the following steps. Firstly, it reads the count data out of positive slope timer 8 on line 33. Then microprocessor 35 resets to zero the positive slope timer count via line 31 and enables, via line **80*a*, a positive peak input switch 80 to connect the output 10 of the positive track and hold 4 through line 24 onto the input 86 of the positive peak input switch 80. This further places the magnitude of the output 10 onto the output B3 of the positive peak input switch 80. The switch 80 output 83 is connected to an the input 82 of an analog to digital converter (A to D) 41. The A to D 41 converts the analog magnitude present on its input line 82** to digital data representing the analog magnitude at sampled instances of time.

This allows the analog to digital converter 41 to perform an A to D conversion of the output signal 10 of the positive track and hold 4. The output 10, as described above, reflects the held maxima of the input signal Vin. At the completion of the analog to digital conversion the microprocessor 35 places the positive track and hold 4 back into the tracking mode via line 17 to the track trigger input of positive track and hold 4.

The analog to digital conversion is initiated from the microprocessor 35 by a control signal provided to the analog to digital converter 41 via line 65. The digital data representative of the converted analog signal is read out of the A to D 41 by the microprocessor 35 on line 64.

Similarly, the same sequence of events described above is performed when the microprocessor 35 receives an interrupt from the negative slope comparator 7 via line 22. The negative peak input switch 81 is enabled by the microprocessor 35, via line **81*a*, connecting the output 13 of negative track and hold 5 on line 85 to the input 82 of the analog to digital converter 41 via line 84**.

As the desired sampling rate of the A to D 41 is dependent upon the highest frequency component of the analog signal Vin the low pass filter 2 may be necessary to limit the highest frequency allowable in Vin. This prevents the comparators 6, 7, which are generally faster than the A to D 41, from performing undesired comparisons at frequencies beyond those the A to D 41 can handle.

SAMPLING RATE AND RESOLUTION

The microprocessor 35 is provided with data indicative of the time duration of a positive or a negative slope of the input signal Vin, and data indicative of the magnitude of the maxima and the minima respectively of the input signal Vin. This provides both frequency information in the form of slope coefficients and amplitude information maxima and minima to the microprocessor 35 for data manipulation according to a desired algorithm.

It can be seen that the limiting factors as to the timing resolution of the system 1 is the frequency of the master clock 26 and the response time of the differential comparators 6, 7. Further it can be seen that this technique allows for a sampling rate of the input signal waveform Vin that is equal to the normal Nyquist uniform sampling theorem criterion of equal to or greater than two times the maximum frequencies of the input signal Vin, yet provides frequency information of the input signal waveform Vin through slope timing with a resolution (frequency discrimination) equivalent to that for which large record lengths and lengthy discrete fourier transform processing times would be required as in prior art methods.

It is apparent that the above described circuit and technique provides essentially a real-time quasi fourier transform system which is capable of performing the time to frequency domain transformation of the highest frequency component of an input signal waveform.

DATA STORAGE AND MANIPULATION

As the processing system 1 described herein also provides for the reconstruction of an analog waveform from slope time and magnitude coefficients as will later be described, it is possible for various forms of manipulation to take place in the digital domain. Modification of the magnitude and/or frequency data may be desirable, as examples, for the purposes of digital filtering, signature analysis, frequency shifting, or bandwidth compression.

The microprocessor 35 is connected to a Read-Only-Memory (ROM) 37 via line 43. The ROM 37 contains the appropriate microcode for the control of the microprocessor 35 in order to provide the various sequence of events heretofore described. The ROM 37 may also contain the appropriate microcode to allow the microprocessor 35 to perform a manipulation of the slope time and magnitude data. The slope time and magnitude data can be stored in and/or read from a RAM 36 via line 30 by the microprocessor 35. The size of the RAM 36 will be dictated by the desired manipulation to be performed on the sampled input signal.

DIGITAL TRANSMISSION

Although FIG. 1 does not depict such a configuration it is possible to output the slope time and magnitude data from the microprocessor 35 in a known manner for digital transmission either prior to or after manipulation.

ANALOG SIGNAL RECONSTRUCTION

As mentioned previously, the processing system 1 also provides for the construction of a continuous analog output signal from the slope time and magnitude data whether manipulated or unmanipulated. Analog transmission is provided thereafter.

The microprocessor 35 sends out the appropriate magnitude data (whether maxima or minima) to a digital to analog converter (D to A) 40 Via line 62. The D to A 40 converts the digital data at its input line 62 and converts the data to an analog magnitude value given by the digital data. A digital to analog conversion may be initiated by the microprocessor 35 via line 63. An analog output value representing the analog magnitude will appear on line 61 from the D to A 40 after the completion of the conversion process. The D to A 40 need only have a conversion speed equal to the conversion speed of the A to D 41.

The analog output 61 from the D to A 40 is fed to the inputs of two sample and holds 68, 69. The positive peak sample and hold 60 receives its input via line 73, and negative peak sample and hold 69 receives its input via line 74. The positive peak sample and hold 68 may be signalled to acquire an analog value by microprocessor 35 via control line 66. Alternatively, negative peak sample and hold 69 may be signalled to acquire an analog by microprocessor 35 via control line 78. Thus, the microprocessor 35 dictates whether positive peak sample and hold 68 or negative peak sample and hold 69 acquires the analog output value 61 from the A to D 40.

The analog signal value held by positive peak sample and hold 68 may be passed on to an input 77 of a low pass filter 72 via line 75 to positive peak output switch 70. Further the analog signal value held by negative peak sample and hold 69 may be passed on to the input 77 of low pass filter 72 via line 76 to negative peak output switch 71. The analog signal can be transmitted on an output line 25 as a $V_{out}$ signal.

The positive peak output switch 70 is controlled via control line 67 from output 53 of a negative slope magnitude comparator 44. Similarly, the negative peak output switch 71 is controlled via control line 79 from output 52 of a positive slope magnitude comparator 42.

The output 53 of negative slope magnitude comparator 44 is also fed to an interrupt on the microprocessor 35 via line 46 and to a run control input on a positive slope counter 39 via line 55.

Similarly the output 52 of positive slope magnitude comparator 42 is also fed to an interrupt input on the microprocessor 35 via line 47 and to a run control input on a negative slope counter 45 via line 54.

The positive slope counter 39 receives a master clock input from the master clock 26 on line 59, and may be reset via line 56 from the microprocessor 35. The negative slope counter 45 receives the master clock input on line 60, and may be reset via line 51 by microprocessor 35.

The positive slope magnitude comparator 42 receives compare data from microprocessor 35 via line 48 and from the positive slope counter 39 via line 57. The negative slope magnitude comparator 44 receives compare data from microprocessor 35 via line 49 and from the negative slope counter 45 via line 58.

To reconstruct a continuous analog output signal $V_{out}$ at output 25 from the digital maxima and minima magnitude data and the respective positive and negative slope time data, the following sequence of events occur.

Assuming that a negative peak (minima) is presently being held by negative peak sample and hold 69 and is about to be output to the low pass filter 72 through negative peak output switch 71, the microprocessor 35 downloads the desired maxima data to the D to A 40, and initiates a conversion. Microprocessor 35 then downloads the positive slope time data to the positive slope magnitude comparator 42. Microprocessor 35 then resets the positive slope counter 39. The negative slope magnitude comparator 44 will produce an output when the negative slope counter 45 output 58 matches the negative slope time data present on line 49. When this occurs, the minima held by the negative peak sample and hold 69 will be output to low pass filter 72. At the same time, the positive slope counter will be started, and the microprocessor 35 will receive an interrupt, on line 46. The microprocessor 35 will now control the positive peak sample and hold 68 to acquire the valid analog output 61 of the D to A 40.

The microprocessor 35 then downloads the negative slope time data to the negative slope magnitude comparator 44 and resets the negative slope counter 45. When the positive slope magnitude comparator 42 detects a match between the positive slope counter 39 output 57 and the positive slope time data present on line 48, the positive peak sample and hold maxima value is output to the low pass filter 72 through positive peak output switch 70, and the entire cycle is repeated.

It can be seen therefore, that an analog staircase shaped signal is presented to the input 77 of the low pass filter 72 via the alternating action of the positive slope magnitude comparator 42, positive slope counter 39, positive peak sample and hold 68 and positive peak output switch 70, and the negative slope magnitude comparator 44, negative slope counter 45, negative peak sample and hold 69 and negative peak output switch 71.

The analog staircase signal is then interpolated and smoothed by the low pass filter 72 to produce a reconstructed continuous analog output signal $V_{out}$.

Figure 2:
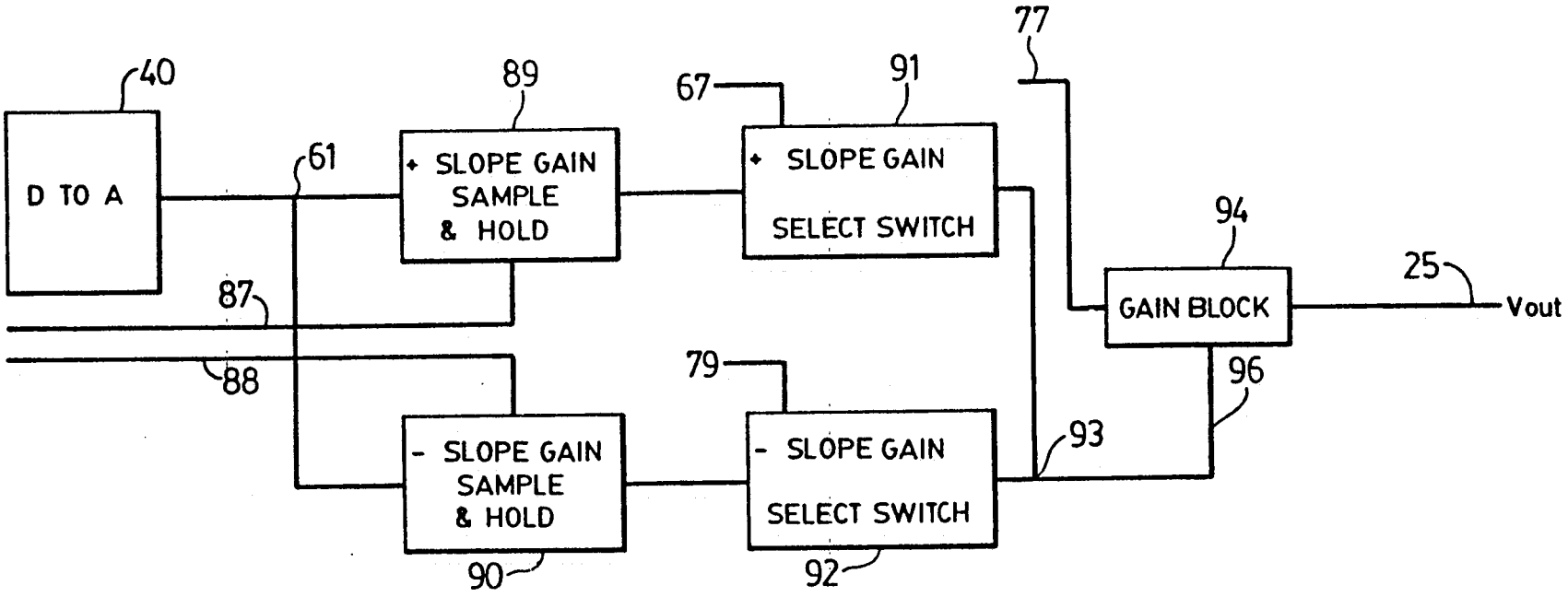

In order to produce a reconstructed continuous analog output signal $V_{out}$ which has a substantially sinusoidal waveform between each maxima and minima the low pass filter 72 may be implemented using a time-variant transfer function filter 74 as shown in FIG. 2.

Input 77 from FIG. 1 is fed through an externally controlled gain block 94 to output 25 to produce $V_{out}$. The block 94 takes its input from a set-up similar to that for the signal reconstruction of FIG. 1.

Contained in ROM 37 is a look-up table containing digital data representing the gain control values necessary to control the block 94. The table data can be arranged in order of corresponding time values between consecutive maxima and minima points, i.e. the greater the time value, the lesser the gain value.

The microprocessor 35 receives counted times between maxima and minima, as described previously, therefore the microprocessor 35 can easily retrieve the appropriate digital gain control value from the look-up table.

The digital gain control value is passed to the D to A converter 40, which has been reproduced in FIG. 2. The D to A 40 converts the digital gain control value to analog form. Thus the D to A converter 40 converts both the amplitude of the signal being reconstructed and its gain control value alternately.

The analog gain control value is output on the line 61 to positive and negative slope gain sample and holds 89, 90. The sample and holds 89, 90 are controlled by output lines 87, 88 respectively from the microprocessor 35 of FIG. 1. These output lines cause the sample and holds 89,90 to pick up the correct analog value from the output of the D to A converter 40.

The outputs of the sample and holds 89, 90 are fed to slope gain select switches 91, 92 respectively.

The select switches 91, 92 are controlled by the control lines 67, 79 respectively from the negative and positive slope magnitude comparators 53, 52 respectively of FIG. 1. This provides for the appropriate analog gain control selection for a positive and a negative slope.

The outputs of the select switches 91, 92 are fed on line 93 to a gain control input 96 on the block 94.

The block 94 is essentially a gain controlled integrator. The data in the look-up table sets the gain of the block 94 according to the time between maxima and minima, which is a measure of the frequency of the original signal. The gain should be set to produce an essentially sinusoidal signal between consecutive maxima and minima of $V_{out}$. For a $V_{out}$ signal having a lesser frequency obviously the gain of the block 94 should be lower and for a $V_{out}$ signal having a greater frequency obviously the gain of the block 94 should be higher.

FREQUENCY EXTRACTION VIA MEMORY MAPPING

A further application of the system 1 is spectral analysis. The lowest frequency of interest must be predetermined. The system 1 is run for a time equal to the inverse of the lowest frequency of interest. During this time each component frequency of the signal Vin will be detected by the system 1.

As the slope times are sent to the microprocessor 35, the microprocessor 35 sets in RAM 36 a flag in a map as a given frequency component or range of frequencies is encountered. The map may be examined at the end of the given time to determine the components of Vin. The size of the RAM 36 may need to be increased to hold the necessary information.

The approximate amount of time for such an analysis is the inverse of the lowest frequency of interest. In known fourier transform systems such an analysis would take the inverse of the desired frequency discrimination plus computation time to perform. Additionally such known systems require increased storage capacity for the large record lengths.

It can be seen that various manipulations and modifications may be made to the original sampled signal while in the digital domain, and that these manipulations may be made to both the amplitude and frequency of the input signal.

Sampling rates are dependent on the highest frequency component in the input waveform, and frequency resolution is not dependent on record length.

Further embodiments of the present invention include processing systems having a number of duplicate blocks combined to provide spectrum analysis. Each block simultaneously tracks a component frequency from an input signal. Each component digital signal may then be individually manipulated and reconstructed as in the processing system 1 previously described. The reconstructed component could be combined to form a fully reconstructed signal.

Other embodiments of the present invention include processing systems which do not reconstruct the analog signal prior to transmission as in the system 1, but transmit slope time and magnitude information in digital form. It would then be received in a known manner in digital form and reconstructed therefrom by a system of similar construction to that of the reconstruction portion of the system 1.

The advantages of the processing systems herein described over normal sampling and subsequent discrete fourier transforms are obvious.

Applications in the areas, for example, of audio and video signature analysis, image processing, real time audio manipulation are numerous.

It will be understood other embodiments of the invention will fall within the spirit and scope of the invention as defined by the following claims.

I claim:

1. A method of analyzing an original analog signal, the method comprising; detecting each maximum and minimum point of the signal; recording the time between each adjacent pair of maximum and minimum points; and sampling and recording the magnitude of the signal at each maximum and minimum point.

2. A method as claimed in claim 1, wherein a time shift is applied to the original analog signal, to create a time shifted signal, and each maximum and minimum is detected by comparing the magnitude of the at a given point in time original signal with the magnitude of the time shifted signal.

3. A method as claimed in claim 2, wherein the magnitude of the signal, at each detected maximum and minimum point, is held prior to being recorded.

4. A method as claimed in claim 3, wherein the original signal is connected through a maximum track and hold device to the positive input of a maximum value comparator, and through a negative track and hold device to the negative input of a minimum value comparator, and the shifted signal is applied to respective negative and positive inputs of the maximum and minimum track and hold devices, and wherein upon detection of a maximum or minimum value, the respective track and hold device is switched to a hold mode in which the respective maximum or minimum value is held by that track and hold device, and the other of the track and hold devices is switched to a tracking mode, tracking the original signal.

5. A method as claimed in claim 4, wherein the output of the maximum and minimum value comparators are connected to peak input switches, which are controlled so as to alternately supply the maximum and minimum values to an output.

6. A method as claimed in claim 4 or 5, wherein the time between each adjacent pair of maximum and minimum points is timed by a negative slope timer, which is connected to the output of, and triggered by, the maximum value comparator, and the time between each adjacent pair of minimum and maximum points is timed by a positive slope timer, which is connected to the output of, and triggered by, the minimum value comparator.

7. A method as claimed in claim 1, 4 or 5, wherein the recorded magnitudes of the maximum and minimum values and the recorded times are digitized.

8. A method as claimed in claim 1, 4 or 5, wherein the original signal is first passed through a lowpass filter, to filter out high frequencies.

9. A method as claimed in claim 1, 4 or 5, wherein the original signal is first passed through a lowpass filter to filter out high frequencies, and the magnitudes of the maximum and minimum values and the recorded times are digitized.

10. A method of reconstructing an analog signal from a data record of maximum and minimum values of the signal and times between adjacent maximum and minimum points, the method comprising sequentially supplying the maximum and minimum values to a sample and hold unit, for holding said values prior to connection through to a lowpass filter; timing the times between the maximum and minimum points, and at the end of each time, connecting the value held in the sample and hold unit through to the lowpass filter and then supplying the next maximum or minimum value to the sample and hold unit.

11. A method as claimed in claim 10, wherein the maximum values are held in a maximum sample and hold and the minimum values are held in a minimum sample and hold, wherein the maximum and minimum values are connected alternatively through to the lowpass filter and at the end of each time the value connected through to the lowpass filter is switched from one sample and hold to the other sample and hold, with said one sample and hold then receiving the next maximum or minimum value.

12. A method as claimed in claim 11, wherein the time between adjacent maximum and minimum values is timed by supplying the recorded time to a magnitude comparator, counting the time in a counter, supplying the counted time to the comparator, and when the counted time is equal to the recorded time resetting the counter and switching the connection to the lowpass filter from one sample and hold to the other sample and hold.

13. A method as claimed in claim 10, 11 or 12, when applied to a digital data record, wherein the maximum and minimum values are converted from digital to analog form before being sent to the sample and hold unit.

14. A method according to claim 10, 11 or 12 wherein the lowpass filter is a time variant filter and the time variant filter is controlled according to the recorded time.

15. A method according to claim 14 wherein the time variant filter integrates the value held in the sample and hold and the level of integration is determined by the inverse of the length of the recorded time.

16. An apparatus for analyzing an original analog signal, the apparatus comprising: a maximum and minimum point detector having an output for the signal and a control output, the control output alternating between first and second states according to detected maximum and minimum points in the signal; timer means having a control input connected to the control output of the detector, the timer means timing the slope times between changes in state of the control output and the timer means having a timer output of the values of the slope times; and a magnitude sampler having a sampler input for the original analog signal and a control input for the control output of the detector, the magnitude sampler sampling the magnitude f the signal when the control output changes state, and the sampler having a magnitude output of the magnitude values of the signal.

17. An apparatus according to claim 16, wherein the maximum and minimum point detector comprises; a tracking means having an input for the analog signal and one output, the tracking means applying a shift to the original signal to produce a shifted signal at said one output, and comparator means having an input for the shifted signal and one input for the original analog signal, the comparator means comparing the original analog signal to the shifted signal to detect maxima and minima of the signal and having an output comprising the control output of the detector.

18. An apparatus according to claim 17, wherein the magnitude sampler comprises hold means having one hold input connected to the sampler input and a control input connected to the control output of the detector, the hold means holding the value of the analog signal when the detector detects a maximum or minimum point, the hold means also including a hold output for the held value.

19. An apparatus according to claim 18, wherein the tracking means comprises positive and negative track devices each having an input for the original signal and respective outputs for the shifted signal, and wherein the comparator means comprising a positive comparator having a negative input connected to the output of the positive track device and a positive input for the original signal, and a negative comparator having a positive input connected to the output of the negative track device and a negative input for the original signal, the positive and negative comparators having outputs comprising the control output of the detector.

20. An apparatus as claimed in claim 19, wherein each of the track devices comprises a track and hold device having a control input connected to the control output of the detector, for holding each sampled magnitude.

21. An apparatus as claimed in claim 20, wherein the timer means comprises a positive slope timer having a control input connected to the output of the negative comparator and a negative slope timer having a control input connected to the output of the positive comparator, the positive and negative timers having outputs for the measured slope times.

22. An apparatus as claimed in claim 18, which includes an analog to digital converter connected to the output of the hold means.

23. An apparatus as claimed in claim 16, 18 or 22 which includes a lowpass filter connected to the input of the maximum and minimum point detector for filtering high frequencies out of the original signal.

24. An apparatus as claimed in claim 21, which includes positive and negative peak input switches, which are connected to the positive and negative track and hold devices respectively, and which include outputs connected to a common output and control outputs connected to the detector, for sequentially switching the maximum and minimum values through to the common output.

25. An apparatus as claimed in claim 24, wherein the common output is connected through to an analog to digital converter.

26. An apparatus for reconstructing an analog signal from a data record of maximum and minimum values of the signal and times between adjacent maximum and minimum points, the apparatus comprising a sample and hold unit for holding, in sequence, the maximum and minimum values, a lowpass filter having an input for the maximum and minimum values and an analog output, a switch means connected between the sample and hold unit and the input of the lowpass filter, and control and storage means for controlling the sample and hold unit and the switch means, the switch means being actuated to sequentially connect the maximum and minimum values through the lowpass filter in accordance with the recorded times.

27. An apparatus as claimed in claim 26, wherein the sample and hold unit comprises a positive sample and hold and a negative sample and hold, and wherein the switch means comprises a positive peak switch connected between the positive sample and hold and the lowpass filter and a negative peak switch connected between the negative sample and hold and the lowpass filter, the peak switches being actuated alternatively to connect the maximum and minimum values to the lowpass filter and the positive and negative sample and holds being supplied with the maximum and minimum values respectively.

28. An apparatus as claimed in claim 26, wherein the control and storage means comprises a counter for counting the times between adjacent maximum and minimum values.

29. An apparatus as claimed in claim 27, wherein the control and storage means includes positive and negative slope counters, and positive and negative slope magnitude comparators, which are connected to outputs of the positive and negative slope counters respectively and to the positive and negative peak switches respectively.

30. An apparatus as claimed in claim 26, 27 or 29, which includes a digital to analog connector connected to the sample and hold unit.

31. An apparatus as claimed in claim 26, 27 or 29 wherein the lowpass filter is a time-variant filter varying according to the recorded values of times.

32. An apparatus as claimed in claim 31 wherein the time-variant filter includes an externally controlled gain block, the maxima and minima time values being input to the block, the block having the analog output, the block having a gain input, the gain of the block being controlled at the gain inputs according to the inverse of the length of the recorded time.

33. A method of manipulating an original analog signal, the method comprising: detecting each maximum and minimum point of the signal; recording the time between each adjacent pair of maximum and minimum points; sampling and recording the magnitude of the original signal at each maximum and minimum point; manipulating the recorded times to produce manipulated times; manipulating the recorded magnitude values to produce manipulated values; sequentially supplying the manipulated values to a sample and hold unit; holding the manipulated values in the sample and hold unit for the duration of the corresponding manipulated time; and outputting the magnitude values through a time-variant low pass filter at the end of each manipulated time.

34. An apparatus for manipulating an original analog signal, the apparatus comprising: a maximum and minimum point detector having an input for the signal and a control output, the control output alternating between first and second states according to detected maximum and minimum points in the signal; timer means having a control input connected to the control output of the detector, the timer means timing the slope times between changes in sate of the control output and the timer means having a timer output for the values of the slope times; a magnitude sampler having a sampler input of the original signal and a control input for the control output of the detector; the magnitude values of the signal; a manipulating unit having a slope time input connected to the timer output of the timer means and having an input for the magnitude values, the manipulation unit for manipulating the slope times to produce manipulated times and for manipulating the magnitude values to produce manipulated values; an output means having a time input of the manipulated times form the manipulating unit, an input of the manipulated values, a sample and hold unit for holding in sequence the manipulated values, a time-variant low pass filter having an input for the manipulated values and an analog output, a switch means connected between the sample and hold unit and the input of the low pass filter, and control and storage means for controlling the sample and hold unit and the switch means, the switch means being actuated to sequentially connect the manipulated values through the time-variant low pass filter in accordance with the manipulated times.

* * * * *